United States Patent [19]

Vermaat

[11] Patent Number: 5,017,329

[45] Date of Patent: May 21, 1991

[54] APPARATUS FOR INSPECTING AND REPAIRING THE TUBES OF A NUCLEAR POWER PLANT

[75] Inventor: Huibrecht P. Vermaat, Av Rockanje, Netherlands

[73] Assignee: Vermaat Technics B.V., Rockanie, Netherlands

[21] Appl. No.: 459,949

[22] Filed: Jan. 2, 1990

[51] Int. Cl.[5] ..... G21C 17/00

[52] U.S. Cl. ..... 576/249; 376/245

[58] Field of Search ..... 376/245, 249; 165/95

[56] References Cited

U.S. PATENT DOCUMENTS 4,798,321 1/1989 Moran ..... 228/183

*Primary Examiner*—Brooks H. Hunt
*Assistant Examiner*—Meena Celliah
*Attorney, Agent, or Firm*—Zarley, McKee, Thomte, Voorhees & Sease

[57] ABSTRACT

By providing a yoke (36) to the shoulder (15) of a robot for inspecting and repairing the tubes of a nuclear boiler, which yoke can receive an expandable anchoring piece (35) of an auxiliary tool (23) connected to the wrist (18) of the robot, said auxiliary tool (23) being provided with additional span fingers (37, 38), it is no longer a time-consuming and therefore expensive procedure to also inspect the tubes that lead to the tube sheet passages (9) into which the usual span fingers (8) of the robot were originally fixed.

5 Claims, 2 Drawing Sheets

APPARATUS FOR INSPECTING AND REPAIRING THE TUBES OF A NUCLEAR POWER PLANT

Figure 1:
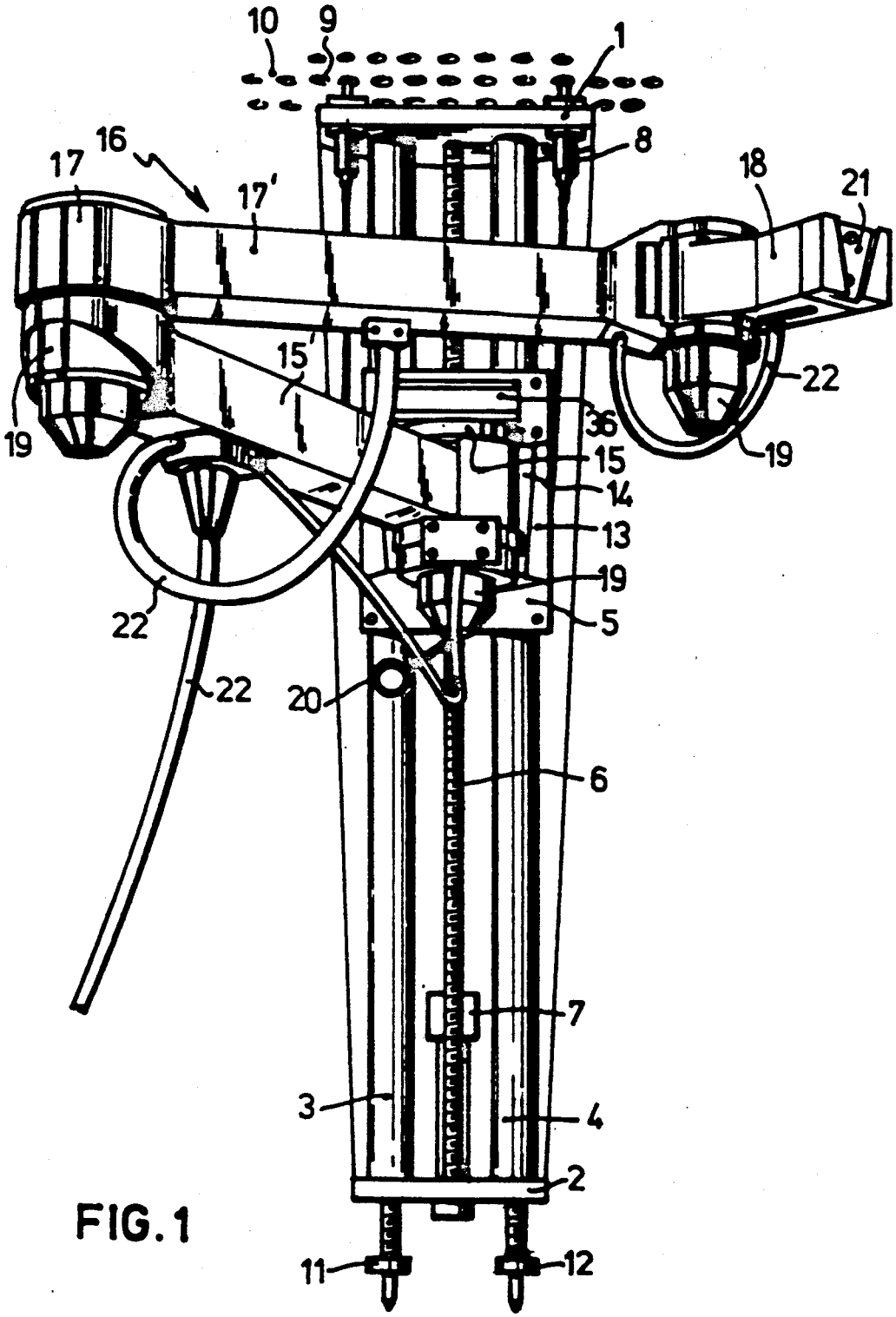

The invention relates to an apparatus for inspecting and repairing the tubes of a boiler of a nuclear power plant, which apparatus can be hoisted through a manhole of the boiler to a tube sheet and which apparatus comprises upper and lower plates connected by guide bars along which a carriage can be moved back and forth, to which carriage an arm assembly consisting of a shoulder with pivotably connected upper arm, an elbow with pivotably connected lower arm and a wrist can be connected, which arm assembly can be connected to inspection and or repair tools at the wrist, which faces away from the carriage, wherein said carriage and said arm assembly comprise drive means for remote-controlling the inspection or repair tools, and wherein the upper plate can be fixed by means of span fingers in two passages of the tube sheet.

During inspection one cannot omit the tubes that lead to the passages in which the span fingers of the apparatus are situated. On account of radio-activity, it is a time-consuming and therefore expensive task to displace the span fingers to the passages of tubes that have already been inspected.

The invention aims to improve the above-described situation. According to the invention, this has been attained in that a yoke has been mounted on the shoulder, which yoke can receive an anchoring piece of an auxiliary tool connected to the wrist, said tool comprising two additional span fingers that can be fixed in other passages of the tube sheet so as to permit the transfer of the span fingers of the upper plate to another set of passages of the tube sheet.

The auxiliary tool may consist of two guide bars connected by means of end partitions, along which bars a table connected to the anchoring piece can be moved back and forth, the additional span fingers being mounted on the end partitions.

The end partitions of the auxiliary tool are preferably exchangeable in order to adapt the pitch distance of the additional span fingers to the tube pitch of the tube sheet.

Figure 2:
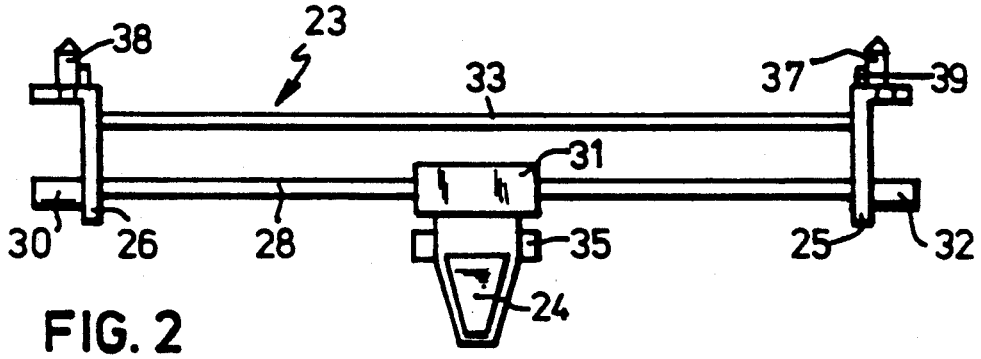
Figure 3:
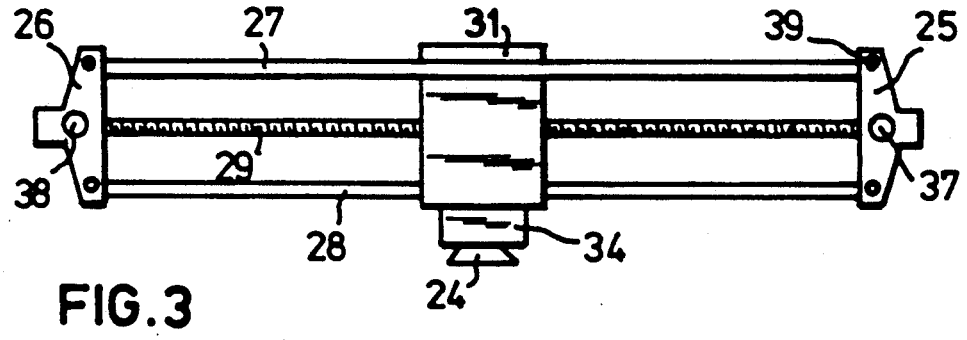
Figure 4:
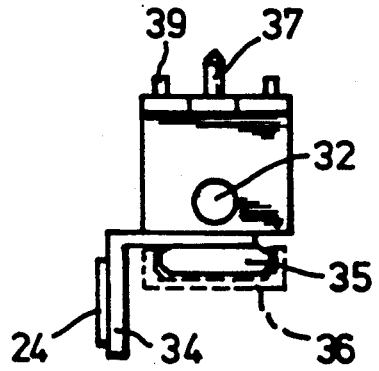

The invention will be further elucidated hereinafter on the basis of the drawing, representing, by means of an example, an embodiment of an apparatus according to the invention. In the drawing:

FIG. 1 shows, in perspective, an apparatus for inspecting and repairing without auxiliary tool, and FIGS. 2–4 show a rear view, a plan view and a side view of an auxiliary tool according to the invention.

The apparatus represented in FIG. 1 comprises an upper plate 1 and a lower plate 2 which are connected by two guide bars 3 and 4. A carriage 5 can be moved along the guide bars 3 and 4. Said motion is effected in that the carriage comprises a screw sleeve (not shown) that is mounted on a spindle 6 extending through the carriage 5, which spindle can be rotatably driven by a drive means 7.

The top plate 1 comprises two span fingers 8 that can be fixed in passages 9 of a tube sheet 10 of the boiler. The term span fingers is understood to refer to fixing means that can be inserted when they are of smaller diameter and that can expand after insertion, so that a firm fixture between the two parts can be obtained.

The bottom plate 2 comprises two vertically adjustable support legs 11 and 12, with the aid of which the apparatus can be elongated in order to insert the span fingers 8 into the passages 9.

The carriage 5 comprises a receiving dovetail portion 13 devised in the known manner for receiving an inserting dovetail portion 14 of a shoulder 15 of an arm assembly 16 which furthermore also comprises an upper arm 15', an elbow 17 and a lower arm 17', and a wrist 18. Due to a drive means 19 the upper arm 15' is able to rotate about a vertical shaft with respect to the shoulder 15, and the same is applicable to the rotation options between the lower arm 17' and the upper arm 15', and the wrist 18 and the lower arm 17', respectively. In this manner, together with a carriage 5 all points in a three-dimensional space can be accurately reached.

After the parts 1–13 have been hoisted through a manhole into the boiler and have been fixed therein, the parts 14–19 are mounted thereon with the aid of the dovetail joint 13/14. In order to be able to release this joint again upon removing the apparatus, a known release lever 20 has been mounted.

At its end, the wrist 18 comprises a receiving dovetail portion 21, arranged in the known manner, from which tools for inspecting or repairing can be suspended.

With the aid of cables 22 and cameras and monitors (not shown) the entire apparatus, which can be regarded as a robot, can be remote-controlled.

According to the invention, the receiving dovetail portion 21 of the wrist 18 can also be used for positioning an inserting dovetail portion 24 of an auxiliary tool 23 represented in FIGS. 2–4.

The auxiliary tool 23 comprises two guide bars 27 connected by end partitions 25 and 26. A screw spindle 29 is positioned between the guide bars, which spindle can be driven by a drive means 30, so that with the aid of a screw sleeve fixedly mounted into the table 31, the table can be displaced back and forth along the guide bars. The conduits necessary for driving the carriage are connected to a code transmitter 32 and extend through a cable gutter 33 to the drive means 30.

The inserting dovetail portion 24 of the auxiliary tool 23 is mounted on the outside of a vertical portion of a corner piece 34. The horizontal portion of the corner piece 34 is mounted under the table 31 and below this horizontal portion there is an anchoring piece 35 that can end up of its own accord in a yoke 36 mounted on the shoulder 15, indicated by a dotted line in FIG. 4, that is if the robot is correctly remote-controlled. Once the anchoring piece 35 is placed in the yoke 36, then the anchoring piece can expand so that a firm connection to the yoke is established.

Additional span fingers 37 and 38 are mounted onto the end partitions 25 and 26 of the auxiliary tool 23, so that the robot can be temporarily suspended, as it were, from the additional span fingers 37 and 38, after which the span fingers 8 of the upper plate 1 can be programmed to be transferred to another set of passages 9 of the tube sheet 10. With the invented auxiliary tool the robot can thus be transferred rapidly to another position with respect to the tube sheet, so that the tubes in which the span fingers 8 of the upper plate were located can also be inspected or repaired.

Perhaps needless to say that during these operations numerous precautions have to be observed in order to prevent radio-active contamination of environment and personnel. One of the precautions is that sensors 39 can be mounted on top of the end partitions 25 and 25, which sensors assess whether the auxiliary tool 23 has accurately arrived at its destination.

The end partitions 25 and 26 are exchangeable so as to have the additional span fingers 37 and 38 at the correct pitch and diameter with respect to the passages 9 of the pipe plate 10.

Other embodiment than those represented by the drawing may also be within the scope of the claims.

I claim:

1. Apparatus for inspecting and repairing the tubes of a boiler of a nuclear power plant, which apparatus can be hoisted through a manhole of the boiler to a tube sheet and which apparatus comprises upper and lower plates connected by guide bars along which a carriage can be moved back and forth, to which carriage an arm assembly consisting of a shoulder with pivotably connected upper arm, an elbow with pivotably connected lower arm and a wrist can be connected, which arm assembly can be connected to inspection and or repair tools at the wrist, which faces away from the carriage, wherein aid carriage and said arm assembly comprise drive means for remote-controlling the inspection or repair tools, and wherein the upper plate can be fixed by means of first span fingers in two passages of the tube sheet, characterized in that a yoke (36) has been mounted on the shoulder (15) that can receive an anchoring piece (35) of an auxiliary tool (23) connected to the wrist (18), said tool comprising two additional span fingers (37, 38) that can be fixed in other passages (9) of the tube sheet (10) so as to permit the transfer of the first span fingers (8) of the upper plate (1) to another set of passages of the tube sheet, the transfer being accomplished without opening the manhole of the boiler.

2. Apparatus according to claim 1, characterized in that the auxiliary tool (23) consists of two guide bars (27, 28) connected by means of end partitions (25, 26) along which bars a table (31) connected to the anchoring piece (35) can be moved back and forth, the additional span fingers (37, 38) being mounted on the end partitions (25, 26).

3. Apparatus according to claim 1 or 2, characterized in that the end partitions (25, 26) of the auxiliary tool (23) are exchangeable in order to adapt the pitch distance of the additional span fingers (37, 38) to the tube pitch of the tube sheet (10).

4. Apparatus according to one of claims 1–3, characterized in that approach sensors (39) are mounted on top of the end partitions (25, 26).

5. Apparatus according to claim 1 characterized in that the auxiliary tool (23) is directly supported by the shoulder (15) when moving the first span fingers from the other passages (9) towards either of the two passages, so as to maintain stability of the apparatus.

* * * * *